United States Patent [19]

Hasebe et al.

[11] 4,388,401

[45] Jun. 14, 1983

[54] MULTILAYER COLOR REVERSAL LIGHT-SENSITIVE MATERIAL

[75] Inventors: Kazunori Hasebe; Yoshisato Minagawa, both of Kanagawa, Japan

[73] Assignee: Fuji Photo Film Co., Ltd., Kanagawa, Japan

[21] Appl. No.: 335,412

[22] Filed: Dec. 29, 1981

[30] Foreign Application Priority Data

Dec. 29, 1980 [JP] Japan ..... 55/185668

[51] Int. Cl.[3] ..... G03C 1/76

[52] U.S. Cl. ..... 430/505; 430/506; 430/507; 430/509; 430/543; 430/567

[58] Field of Search ..... 430/506, 503, 509, 567, 430/507, 543, 505

[56] References Cited

U.S. PATENT DOCUMENTS

| | | | |
|---|---|---|---|
| 2,231,684 | 2/1941 | Schinzel | 430/509 |
| 2,376,217 | 5/1945 | Wilder | 430/506 |
| 3,620,746 | 11/1971 | Barr | 430/509 |
| 3,728,121 | 4/1973 | Zorn et al. | 430/509 |
| 3,843,369 | 10/1974 | Kumai et al. | 430/506 |

FOREIGN PATENT DOCUMENTS 56-25738 3/1981 Japan .

*Primary Examiner*—J. Travis Brown

*Attorney, Agent, or Firm*—Sughrue, Mion, Zinn, Macpeak & Seas

[57] ABSTRACT

A multilayer color reversal light-sensitive material is described, which can provide dye images having improved sharpness and graininess without a drop in color reproducibility, by employing a specific arrangement and construction of emulsion layers in its multi-layer structure, viz., a material comprising a support, a yellow filter layer, a group of green-sensitive emulsion layers, and a group of red-sensitive emulsion layers, wherein said emulsion layer groups are positioned nearer to the support than the yellow filter layer, each of the emulsion layer groups comprises at least two adjacent layers including a high-sensitivity silver halide emulsion layer containing silver halide grains having an average size of from 0.6μ to 2.0μ and a low-sensitivity silver halide emulsion layer containing silver halide grains having an average grain size of from 0.1μ to 0.5μ, and at least one of the green-sensitive low-sensitivity emulsion layer or the red-sensitive low-sensitivity emulsion layer is positioned farther from the support than the high-sensitivity emulsion layer of the corresponding emulsion layer group.

9 Claims, No Drawings

MULTILAYER COLOR REVERSAL LIGHT-SENSITIVE MATERIAL

FIELD OF THE INVENTION

This invention relates to a multilayer color reversal light-sensitive material, and particularly to such a material that provides dye image having improved sharpness and graininess, by employing a novel arrangement of emulsion layers in the multilayer structure.

BACKGROUND OF THE INVENTION

A color light-sensitive material for picture-taking generally has three layers; that is, a red-sensitive emulsion layer, a green-sensitive emulsion layer, and a blue-sensitive emulsion layer, in which the red-sensitive emulsion layer, the green-sensitive emulsion layer, a yellow filter layer and the blue-sensitive emulsion layer are arranged, in the order listed, on a support, with the intention of allowing light, the color of which is complementary to the color image to be produced in each of the color-forming emulsion layers, to reach each particular layer.

Hitherto, improvements in image sharpness and graininess using conventional color light-sensitive materials have been attempted by changing the conventional arrangement of emulsion layers employed therein. For example, U.S. Pat. No. 4,157,917 discloses a construction and arrangement of emulsion layers such that the green-sensitive emulsion forms two separate layers, and one of them is disposed at the topmost position of all light-sensitive layers. However, such an arrangement suffers from the defect that it exerts a bad effect upon the color reproducibility since the green-sensitive emulsion layer provided at the topmost position responds not only to green light, which color is complementary to that of dye image to be produced therein, but also to a different color of light (specifically, blue light), and, consequently, dye stain is formed in the topmost green-sensitive emulsion layer. Furthermore, the spectral sensitivity of the blue-sensitive emulsion layer tends to be distorted.

In some cases, such a construction that each of the above-described emulsion layers is resolved into at least two layers having different sensitivities is used. For example, in one construction a high-sensitivity emulsion layer and a low-sensitivity emulsion layer are used, wherein each high-sensitivity emulsion layer is disposed farther from the support than the corresponding low-sensitivity emulsion layer; such a construction has been adopted in multilayer color light-sensitive materials for picture-taking for the purpose of improvement upon gradation and expansion of exposure latitude. However, sensitive materials having such a construction and such an arrangement are found to produce color pictures of insufficient image sharpness, and, when they are subjected to the color reversal processing a remarkable drop in graininess is observed in the color images obtained, compared with the case wherein they are subjected to color negative processing.

Moreover, Japanese Patent Application (OPI) No. 25738/81 (the term "OPI" as used herein refers to a "published unexamined Japanese patent application") discloses a color light-sensitive material of a kind which may be processed color reversal processing, in which both green-sensitive, high-sensitivity emulsion layer and red-sensitive, high-sensitivity emulsion layer are positioned nearer to the support than both green-sensitive, low-sensitivity emulsion layer and red-sensitive, low-sensitivity emulsion layer. In such an arrangement of emulsion layers, it is necessary for the purpose of preventing a color mixing phenomenon from occurring to provide an interlayer between the green-sensitive, high-sensitivity emulsion layer and the red-sensitive, high-sensitivity emulsion layer and further, to provide another interlayer between the green-sensitive, low-sensitivity emulsion layer and the red-sensitive, low-sensitivity emulsion layer. Therefore, this sensitive material suffers the disadvantage that the total thickness of the coated emulsion layers is increased, causing a decrease in image sharpness.

SUMMARY OF THE INVENTION

Therefore, an object of this invention is to provide a multilayer color reversal light-sensitive material which produces dye images having improved sharpness and improved graininess without impairing the color reproducibility.

The above-described object is accomplished with a multilayer color reversal light-sensitive material comprising a support, a yellow filter layer, a group of green-sensitive emulsion layers, and a group of red-sensitive emulsion layers, wherein said emulsion layer groups are positioned nearer to the support than the yellow filter layer, each of the emulsion layer groups comprises at least two adjacent layers, including a high-sensitivity silver halide emulsion layer containing silver halide grains having an average size of from $0.6\mu$ to $2.0\mu$, and a low-sensitivity silver halide emulsion layer containing silver halide grains having an average size of $0.1\mu$ to $0.5\mu$, and at least one of the green-sensitive, low-sensitivity emulsion layer or the red-sensitive, low-sensitivity emulsion layer is positioned farther from the support than the high-sensitivity emulsion layer of the corresponding emulsion layer group.

DETAILED DESCRIPTION OF THE INVENTION

Arrangements of emulsion layers in multilayer reversal type color sensitive materials which constitute this invention are described below in further detail. The group of green-sensitive emulsion layers and the group of red-sensitive emulsion layers are provided at positions nearer to the support than the yellow filter layer. The differently sensitized emulsion layer groups may be arranged in any order. However, it is preferred to arrange the group of red-sensitive emulsion layers at a position nearer to the support than the group of green-sensitive emulsion layers, for the enhancement of color reproducibility. The green-sensitive emulsion layer group of this invention comprises at least two layers, including a green-sensitive low-sensitivity emulsion layer and a green-sensitive high-sensitivity emulsion layer, and these emulsion layers are disposed so as to be adjacent to each other. On the other hand, the red-sensitive emulsion layer group also comprises at least two layers including a red-sensitive low-sensitivity emulsion layer and a red-sensitive high-sensitivity emulsion layer, and these emulsion layers are also disposed so as to be adjacent to each other. The green-sensitive low-sensitivity emulsion layer included in the green-sensitive emulsion layer group of this invention is arranged farther from the support than the green-sensitive high-sensitivity emulsion layer, or alternatively, or simultaneously, the red-sensitive low-sensitivity emulsion layer is arranged farther from the support than the red-sensitive high-sensitivity emulsion layer.

When this invention is embodied as a reversal light-sensitive material for color photography, a blue-sensitive emulsion layer is provided at a position farther from the support than the yellow filter layer. Some arrangement examples of preferred embodiments are shown below:

Arrangement Example 1

(1) Support
(2) Red-sensitive high-sensitivity emulsion layer
(3) Red-sensitive low-sensitivity emulsion layer
(4) Interlayer
(5) Green-sensitive high-sensitivity emulsion layer
(6) Green-sensitive low-sensitivity emulsion layer
(7) Yellow filter layer
(8) Blue-sensitive emulsion layer Arrangement Example 2

(1) Support
(2) Red-sensitive low-sensitivity emulsion layer
(3) Red-sensitive high-sensitivity emulsion layer
(4) Interlayer
(5) Green-sensitive high-sensitivity emulsion layer
(6) Green-sensitive low-sensitivity emulsion layer
(7) Yellow filter layer
(8) Blue-sensitive emulsion layer and so on.

The "average grain size" as referred to herein can be determined by the grain size measuring methods described in C. E. K. Mees and T. H. James, *The Theory of the Photographic Process* (published by Macmillan), from the 7th line from the bottom in the right column on page 36 to the 18th line in the left column on page 38, and in *Particle Size Analysis* (1966), 4th Edition, from page 45, published in 1977.

A preferred average grain size of silver halide which constitutes the low-sensitivity emulsion layer of this invention ranges from 0.15μ to 0.4μ, and that of silver halide which constitutes the high-sensitivity emulsion layer of this invention ranges from 0.7μ to 1.5μ. The apparent sensitivity of the low-sensitivity emulsion layer can be raised by adopting the arranging order of emulsion layers according to this invention, and therefore silver halide grains having a small average size as described above can be employed for the low-sensitivity emulsion layer. Consequently, it becomes possible to further improve the graininess properties in low density areas of image. In addition, the use of silver halide having grain sizes within the range of 0.55±0.1μ, which scatters light most strongly, can be avoided by the use of silver halide having the above-described preferred average grain size, whereby a further improvement in image sharpness can be attained.

The grain size distribution of the emulsions employed in this invention may be either narrow or wide.

The silver halide grains in the photographic emulsion may have a regular crystal form such as a cubic structure, an octahedral structure or the like, an irregular crystal form, such as a spherical form, a plate form, or so on, or a composite form of these crystal forms. Alternatively, the silver halide grains in the photographic emulsion may be a mixture of grains having different crystal forms.

The silver halide grains may be composed of different phases, such as wherein the core thereof is different from the shell, or may be homogeneous. Further, the grains may be those wherein latent images are formed mainly on the surface thereof (surface latent image type silver halide grain), or may be those wherein latent images are formed mainly in the interior thereof (interior latent image type silver halide grain).

The photographic emulsions to be employed in this invention can be prepared using methods as described in P. Glafkides, *Chimie et Physique Photographique,* Paul Montel (1967), G. F. Duffin, *Photographic Emulsion Chemistry,* The Focal Press (1966), V. L. Zelikman, et al., *Making and Coating Photographic Emulsion,* The Focal Press (1964), and so on. Namely, the photographic emulsions may be made using the acid process, the neutral process, the ammonia process, or any other known process, and the reaction of soluble silver salts with soluble halides may be carried out using a single jet method, a double jet method, a combination of these methods, or so on.

The method of forming silver halide grains under the condition of excess silver ion (the so-called reverse mixing method) can be also used. Further, a method which belongs to the category of the double jet method, and in which a pAg value of the liquid phase wherein silver halides are produced is maintained constant, that is, the so-called controlled double jet method, can also be used.

In accordance with this method, emulsions containing silver halide grains having a regular crystal form and nearly uniform grain sizes can be obtained.

Two or more kinds of silver halide emulsions produced separately may be mixed to make an emulsion having a particularly intended composition.

The silver halide grain formation or physical ripening process may be carried out in the presence of a cadmium salt, a zinc salt, a lead salt, a thallium salt, an iridium salt or a complex salt thereof, a rhodium salt or a complex salt thereof, an iron salt or a complex salt thereof, or so on.

Suitable examples of silver halides which can be contained in photographic emulsion layers of the photographic light-sensitive materials to be employed in this invention include silver bromide, silver iodobromide, silver iodochlorobromide, silver chlorobromide and silver chloride.

The sensitive material of this invention may contain water-soluble dyes in hydrophilic colloid layers as a filter dye, or for the purpose of preventing the irradiation effect which means an effect that rays of light incident upon a light-sensitive layer of a photographic light-sensitive material is reflected or scattered in the emulsion and the light-sensitive layer is exposed by the incident light and the reflected or scattered light, and accordingly an image sharpness is deteriorated, or for various other purposes. Such dyes include oxonol dyes, hemioxonol dyes, styryl dyes, merocyanine dyes, cyanine dyes and azo dyes. Of these dyes, oxonol dyes, hemioxonol dyes and merocyanine dyes are more useful. Specific examples of dyes employable in the sensitive materials of this invention include those which are described in British Pat. Nos. 584,609 and 1,177,429, Japanese Patent Application (OPI) Nos. 85130/73, 99620/74, 114420/74 and 108115/77, and U.S. Pat. Nos. 2,274,782; 2,533,472; 2,956,879; 3,148,187; 3,177,087; 3,247,127; 3,540,887; 3,575,704; 3,653,905; 3,718,472; 4,071,312 and 4,070,352.

Dyes, ultraviolet absorbing agents, and the like may be mordanted with cationic polymers or the like when incorporated in hydrophilic colloid layers which constitute the sensitive material of this invention. For this purpose, polymers which can be used are described, for example, in British Pat. No. 685,475, U.S. Pat. Nos. 2,675,316; 2,839,401; 2,882,156; 3,048,487; 3,184,309; and 3,445,231, German Patent Application (OLS) No. 1,914,362, and Japanese Patent Application (OPI) No. 47624/75.

As a binding agent or a protective colloid for photographic emulsions, gelatin can be employed to advantage. However, hydrophilic colloids other than gelatin can also be employed.

Examples of such hydrophilic colloids include proteins such as gelatin derivatives, graft polymers of gelatin and other macromolecular substances, albumin, casein, etc.; sugar derivatives such as cellulose derivatives (e.g., hydroxyethyl cellulose, carboxymethyl cellulose, cellulose sulfuric acid esters and the like), sodium alginate, starch derivatives, etc.; and various kinds of synthetic hydrophilic homopolymers or copolymers such as polyvinyl alcohol, partially acetalated polyvinyl alcohol, poly-N-vinylpyrrolidone, polyacrylic acid, polymethacrylic acid, polyacrylamide, polyvinyl imidazole, polyvinyl pyrazole, etc.

As for gelatin, not only lime-processed gelatin but also acid-processed gelatin and enzyme-processed gelatin as described in *Bull. Soc. Sci. Phot. Japan,* No. 16, page 30 (1966) may be employed. Further, the hydrolysis products of gelatin and the enzymatic decomposition products of gelatin can be also employed. As for the gelatin derivatives, reaction products of gelatins with various kinds of compounds such as acid halides, acid anhydrides, isocyanates, bromoacetic acid, alkane sultones, vinyl sulfonamides, maleinimides, polyalkylene oxides, epoxy compounds and so on can be employed. Specific examples of such gelatin derivatives are described in U.S. Pat. Nos. 2,614,928; 3,132,945; 3,186,846; and 3,312,553, British Pat. Nos. 861,414; 1,033,189 and 1,005,784, Japanese Patent Publication No. 26845/67, and so on.

Suitable examples of the above-described gelatin graft polymer include those which are obtained by grafting on gelatins homo- or copolymers of vinyl monomers such as acrylic acid, methacrylic acid, derivatives of these acids (e.g., esters thereof, amides thereof, etc.), acrylonitrile, styrene and so on. More preferable graft polymers are those which are grafted with polymers compatible with gelatin to some degree, such as acrylic acid polymers, methacrylic acid polymers, acrylamide polymers, methacrylamide polymers, hydroxyalkylmethacrylate polymers and the like. Specific examples of such preferable graft polymers are described in U.S. Pat. Nos. 2,763,625; 2,831,767 and 2,956,884, and so on.

Typical examples of synthetic hydrophilic polymeric substances include those which are described in German Patent Application (OLS) No. 2,312,708, U.S. Pat. Nos. 3,620,751 and 3,879,205, and Japanese Patent Publication No. 7561/68.

The sensitive material of this invention may contain an ultraviolet absorbing agent in one or more of its hydrophilic colloid layers. Examples of the ultraviolet absorbing agent include benzotriazole compounds substituted by aryl groups (e.g., those described in U.S. Pat. No. 3,533,794), 4-thiazolidone compounds (e.g., those which are described in U.S. Pat. Nos. 3,314,794 and 3,352,681), benzophenone compounds (e.g., those described in Japanese Patent Application (OPI) No. 2784/71), cinnamic acid ester compounds (e.g., those described in U.S. Pat. Nos. 3,705,805 and 3,707,375), butadiene compounds (e.g., those which are described in U.S. Pat. No. 4,045,229) and benzoxazole compounds (e.g., those described in U.S. Pat. No. 3,700,455). In addition, those which are described in U.S. Pat. No. 3,499,762 can be employed as the ultraviolet absorbing agent. On the other hand, ultraviolet rays may be absorbed by using ultraviolet absorbing couplers (such as α-naphthol type cyan dye-forming couplers), ultraviolet absorbing polymers or the like. These ultraviolet absorbing agents may be mordanted in a specific layer.

The photographic emulsions of this invention may be spectrally sensitized with methine dyes. Dyes employable for this purpose include cyanine dyes, merocyanine dyes, complex cyanine dyes, complex merocyanine dyes, holopolar cyanine dyes, hemicyanine dyes, styryl dyes and hemioxonol dyes. Particularly useful sensitizing dyes are those which belong to a class of cyanine dyes, a class of merocyanine dyes and a class of complex merocyanine dyes. In these dyes, any nucleus which is typically employed as a basic heterocyclic nucleus in cyanine dyes can be used. Such nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; nuclei consisting of these nuclei and alicyclic hydrocarbon rings fused together; and nuclei consisting of the above-described nuclei and aromatic hydrocarbon rings fused together, with specific examples including an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, and the like.

To merocyanine dyes or complex merocyanine dyes may be applied, as the nuclei having a ketomethylene structure, 5- and 6-membered heterocyclic nuclei with specific examples including a pyrazoline-5-one nucleus, a thiohydantoin nucleus, a 2-thiooxazolidine-2,4-dione nucleus, a thiazolidine-2,4-dione nucleus, a rhodanine nucleus, a thiobarbituric acid nucleus and the like.

Specific examples of useful sensitizing dyes include those which are described in, for example, German Pat. No. 929,080, U.S. Pat. Nos. 2,231,658; 2,493,748; 2,503,776; 2,519,001; 2,912,329; 3,656,959; 3,672,897; 3,694,217; 4,025,349; and 4,046,572; British Pat. No. 1,242,588, Japanese Patent Publication Nos. 14030/69 and 24844/77, and so on.

These sensitizing dyes may be used independently or in a combined form. The combination of sensitizing dyes has been frequently employed for the purpose of supersensitization. Typical examples of such combinations are described in U.S. Pat. Nos. 2,688,545; 2,977,229; 3,397,060; 3,522,052; 3,527,641; 3,617,293; 3,628,964; 3,666,480; 3,672,898; 3,679,428; 3,703,377; 3,769,301; 3,814,609; 3,837,862; and 4,026,707, British Pat. Nos. 1,344,281 and 1,507,803, Japanese Patent Publication Nos. 4936/68 and 12375/78, and Japanese Patent Application (OPI) Nos. 110618/77 and 109925/77.

Substances which can exhibit a supersensitizing effect when used in combination with sensitizing dyes, though they do not have any spectral sensitization effect in themselves in spite of dyes, or though they do not absorb substantially visible rays, may be incorporated in emulsions. Examples of such substances may include aminostilbene compounds substituted with nitrogen-containing heterocyclic groups (e.g., those which are described in U.S. Pat. Nos. 2,933,390 and 3,635,721), condensates of aromatic organic acids and formaldehyde (e.g., those which are described in U.S. Pat. No. 3,743,510), cadmium salts, azaindene compounds, and so on. The combinations described in U.S. Pat. Nos. 3,615,613; 3,615,641; 3,617,295; and 3,635,721 are particularly useful.

The photographic emulsion layers of the sensitive materials produced in accordance with embodiments of this invention may contain dye-forming couplers, that is, compounds capable of forming dyes by reacting with oxidation products of aromatic amine (usually a primary amine) developing agents (these are referred to simply as couplers hereafter). It is desirable for the couplers to have non-diffusible properties by containing hydrophobic groups called ballast groups in their respective molecular structures. The coupler may be either four-equivalent or two-equivalent with respect to silver ion. Further, the couplers may include colored couplers having the color correction effect, and couplers capable of releasing development inhibitors with a progress of development (the so-called DIR couplers). Furthermore, the couplers may include those which produce colorless compounds by coupling reactions.

As a yellow color-forming coupler can be employed known open-chain ketomethylene series couplers. Benzoylacetanilide series and pivaloylacetanilide series compounds are of greater advantage than other open-chain ketomethylene series couplers. Specific examples of yellow color-forming couplers include those which are described in U.S. Pat. Nos. 2,875,057; 3,265,506; 3,408,194; 3,551,155; 3,582,322; 3,725,072; and 3,891,445, German Pat. No. 1,547,868, German Patent Application (OLS) Nos. 2,219,917; 2,261,361; and 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77, and 115219/77, and so on.

Magenta color-forming couplers that can be employed include pyrazolone series compounds, indazolone series compounds, cyanoacetyl compounds, and the like. In particular, pyrazolone series compounds can be employed to advantage. Specific examples of useful magenta color-forming couplers include those which are described in U.S. Pat. Nos. 2,600,788; 2,983,608; 3,062,653; 3,127,269; 3,311,476; 3,419,391; 3,519,429; 3,558,319; 3,582,322; 3,615,506; 3,834,908; and 3,891,445, German Pat. No. 1,810,464, German Patent Application (OLS) Nos. 2,408,665; 2,417,945; 2,418,959; and 2,424,467, Japanese Patent Publication Nos. 6031/65, and 45990/76, Japanese Patent Application (OPI) Nos. 20826/76, 58922/77, 129538/74, 74027/74, 159336/75, 42121/77, 74028/74, 60233/75, 26541/76, and 55122/78, and so on.

As a cyan color-forming coupler can be employed phenol series compounds, naphthol series compounds and the like. Specific examples thereof include those which are described in U.S. Pat. Nos. 2,369,929; 2,434,272; 2,474,293; 2,521,908; 2,895,826; 3,034,892; 3,311,476; 3,458,315; 3,476,563; 3,583,971; 3,591,383; 3,767,411; and 4,004,929, German Patent Application (OLS) Nos. 2,414,830 and 2,454,329, and Japanese Patent Application (OPI) Nos. 59838/73, 26034/76, 5055/73, 146828/76, 69624/77, and 90932/77.

Colored couplers that can be employed include those which are described, for example, in U.S. Pat. Nos. 3,476,560; 2,521,908; and 3,034,892, Japanese Patent Publication Nos. 2016/69, 22335/63, 11304/67, and 32461/69, Japanese Patent Application (OPI) Nos. 26034/76, and 42121/77, and German Patent Application (OLS) No. 2,418,959.

DIR (development inhibitor releasing) couplers that can be employed include those which are described, for example, in U.S. Pat. Nos. 3,227,554; 3,617,291; 3,701,783; 3,790,384; and 3,632,345, German Patent Application (OLS) Nos. 2,414,006, 2,454,301, and 2,454,329, British Pat. No. 953,454, Japanese Patent Application (OPI) Nos. 69624/77 and 122335/74, and Japanese Patent Publication No. 16141/76.

Compounds capable of releasing development inhibitors according to the progress of development, other than DIR couplers, can be incorporated in the sensitive materials. Such compounds which can be employed include those which are described, for example, in U.S. Pat. Nos. 3,297,445 and 3,379,529, German Patent Application (OLS) No. 2,417,914, and Japanese Patent Application (OPI) Nos. 15271/77 and 9116/78.

Furthermore, two or more kinds of couplers as described above may be incorporated in one layer, and one coupler may be incorporated in two or more different layers.

Couplers as described above can generally be added to an emulsion layer in an amount of from $2\times10^{-3}$ mol to $5\times10^{-1}$ mol, and preferably from $1\times10^{-2}$ mol to $5\times10^{-1}$ mol, per 1 mol of silver in the emulsion layer.

The above-described coupler is introduced into a silver halide emulsion layer in a known manner. For instance, the manner is described in U.S. Pat. No. 2,322,027. Therein, couplers are preliminarily dissolved in high boiling point solvents, such as phthalic acid alkyl esters (e.g., dibutyl phthalate, dioctyl phthalate, etc.), phosphoric acid esters (e.g., diphenyl phosphate, triphenyl phosphate, tricresyl phosphate, dioctylbutyl phosphate, etc.), citric acid esters (e.g., tributyl acetylcitrate, etc.), benzoic acid esters (e.g., octyl benzoate, etc.), alkylamides (e.g., diethyllaurylamide, etc.), fatty acid esters (e.g., dibutoxyethyl succinate, dioctyl azelate, etc.), and so on; or in organic solvents of low boiling points ranging from about 30° C. to 150° C., such as lower alkyl acetates (e.g., ethyl acetate, butyl acetate, etc.), ethyl propionate, secondary butyl alcohol, methyl isobutyl ketone, $\beta$-ethoxyethyl acetate, methyl cellosolve acetate, and so on; then the resulting solutions are dispersed in hydrophilic colloids. Mixtures of the above-described high boiling point solvents and low boiling point solvents may be used therein.

If the couplers contain acid groups such as carboxylic acid and sulfonic acid, the couplers are introduced into hydrophilic colloids in a form of aqueous alkaline solution.

In the sensitive material of this invention, auxiliary layers, such as a subbing layer, a protective layer and the like, may be provided in addition to the above-described layers.

In the sensitive material of this invention which comprises of the group of green-sensitive emulsion layers and the group of red-sensitive emulsion layers, the low-sensitivity emulsion layer is arranged farther from the support than the corresponding high-sensitivity emulsion layer in both or either of the above-described two groups and therefore, silver halides having small grain sizes can be employed for the low-sensitivity emulsion layer and further, silver halides having larger grain sizes can be employed for the high-sensitivity emulsion. Consequently, graininess of image can be remarkably improved without attended by lowering in reversal sensitivity in this invention. In addition, the sharpness of reversal image is also improved to a great extent since the use of silver halide grains having sizes within the range of 0.55±0.1μ, which scatter light most, can be avoided owing to the above-described arrangement and constitution of silver halide emulsion layers. Furthermore, since the sensitive material of this invention has the above-described construction and at the same time, has such a construction that both the green-sensitive emulsion layer group and the red-sensitive emulsion layer group are arranged nearer to the support than the yellow filter layer, green-sensitive emulsion layers and red-sensitive emulsion layers are prevented from being activated or made developable by blue light and, further, the distortion of spectral sensitivity is not caused in blue-sensitive emulsion layers. Consequently, the sensitive material of this invention is excellent in color reproducibility also. Moreover, since the sensitive material of this invention is constructed so that emulsion layers which form image of different colors may not lie between the emulsion layers forming images of the same color, it is unnecessary to provide any extra interlayers. Therefore, a lowering in the image sharpness due to an increase in the thickness of the sensitive material does not occur.

This invention will now be illustrated in greater detail by reference to the following example.

EXAMPLE

Red-sensitive emulsions were prepared as follows.

1-a. Preparation of Emulsion for Low-Sensitivity Emulsion Layer

A silver iodobromide emulsion containing 4 mol% of silver halide, having an average grain size of 0.35μ, and containing 100 g of silver halide and 70 g of gelatin per 1 kg of the emulsion, was prepared in a conventional manner. To a 1 kg portion of the emulsion there was added 180 cc of a 0.1% methanol solution of anhydro-5,5'-dichloro-9-ethyl-3,3'-di(3-sulfopropyl)thiacarbocyanine hydroxide pyridinium salt as a red-sensitive color sensitizer, and then 20 cc of a 5 wt% aqueous solution of 5-methyl-7-hydroxy-2,3,4-triazaindolizine and 330 g of a cyan coupler-containing emulsion (1), which had been made according to the formula described below, were added thereto. 50 cc of a 2 wt% aqueous solution of sodium 2-hydroxy-4,6-dichlorotriazine was added thereto as a gelatin hardening agent. Thus, the emulsion for forming a low-sensitivity unit emulsion layer was made, and this emulsion was designated as (CL-1). In addition, another emulsion was prepared in the same manner as described above, except that the average grain size of the emulsion was changed to 0.28μ. This emulsion was designated as (CL-2).

| Formula of Emulsion (1): | |
|---|---|
| (1) 10 wt % Gelatin in Aqueous Solution | 1,000 g |
| (2) Sodium p-Dodecylbenzenesulfonate | 5 g |
| Tricresyl Phosphate | 60 cc |
| Cyan Coupler | 70 g |
| Ethyl Acetate | 100 cc |

The mixture (2) was heated to 55° C. to dissolve its constituents, and added to (1), which had been previously warmed to 55° C. The resulting mixed solution was emulsified by means of a colloid mill.

Structural Formula of Cyan Coupler:

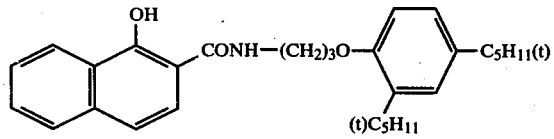

1-b. Preparation of 1st Emulsion for High-Sensitivity Emulsion Layer

An emulsion was prepared in the same manner as in the preparation (1-a), except that an average grain size of the emulsion was changed to 0.65μ, the addition amount of the red-sensitive color sensitizer was changed to 140 cc, and the addition amount of the emulsion (1) was changed to 330 g. The thus-obtained emulsion was designated as (CH-1).

1-c. Preparation of 2nd Emulsion for High-Sensitivity Emulsion Layer

An emulsion was prepared in the same manner as in the preparation (1-a), except that an average grain size of the emulsion was changed to 0.8μ, the addition amount of the red-sensitive color sensitizer was changed to 140 cc, and the addition amount of the emulsion (1) was changed to 330 g. The thus-obtained emulsion was designated as (CH-2).

Green-sensitive emulsions were prepared as follows.

2-a. Preparation of Low-Sensitivity Emulsions

A silver iodobromide emulsion containing 3 mol% of silver iodide, having an average grain size of 0.35μ, and containing 100 g of silver halide and 70 g of gelatin per 1 kg of the emulsion, was prepared in a conventional manner. To a 1 kg portion of the emulsion there was added 200 cc of a 0.1% methanol solution of 3,3'-di(2-sulfoethyl)-9-ethylbenzooxacarbocyanine pyridinium salt as a green-sensitive color sensitizer, and then, 20 cc of a 5 wt% aqueous solution of 5-methyl-7-hydroxy-2,3,4-triazaindolizine and 500 g of magenta coupler-containing emulsion (2), made according to the formula described below, were added thereto. Thereto, 50 cc of a 2 wt% aqueous solution of sodium 2-hydroxy-4,6-dichlorotriazine was furthermore added as a gelatin hardening agent. Thus, the emulsion for forming a low-sensitivity emulsion layer was made, and was designated as (ML-1).

| Formula of Emulsion (2): | |
|---|---|
| (1) 10 wt % Gelatin Aqueous Solution | 1,000 g |
| (2) Sodium p-Dodecylbenzenesulfonate | 5 g |
| Tricresyl Phosphate | 65 cc |
| Magenta Coupler (1-(2,4,6-trichlorophenyl)-3-[3-(2,4-di-t-phenylphenoxyacetamido)benzamido]-5-pyrazolone) | 63 g |
| Ethyl Acetate | 110 cc |

The mixture (2) was heated to 55° C. to dissolve its constituents, and added to (1), which had been previously warmed to 55° C. The resulting mixed solution was emulsified by means of a colloid mill.

Two further emulsions were prepared in the same manner as for (2-a), except that average grain sizes of the emulsions were changed to 0.28μ and 0.20μ, respectively. These emulsions were designated as (ML-2) and (ML-3), respectively.

2-b. Preparation of 1st Emulsion for High-Sensitivity Unit Emulsion Layer

A silver iodobromide emulsion containing 3 mol% of silver iodide, having an average grain size of 0.65μ, and containing 100 g of silver halide and 70 g of gelatin per 1 kg of the emulsion was prepared in a conventional manner. To a 1 kg portion of the emulsion was added 150 cc of the same methanol solution of the green-sensitive color sensitizer that was employed in the preparation (2-a), and then 20 cc of a 5 wt% of aqueous solution of 5-methyl-7-hydroxy-2,3,4-triazaindolizine was added thereto. Then, 500 g of the emulsion (2) was further added thereto and, subsequently, 50 cc of a 2 wt% of aqueous solution of sodium 2-hydroxy-4,6-dichlorotriazine was added as a gelatin hardening agent. Thus, an emulsion for forming a high-sensitivity emulsion layer was made, and this emulsion was designated as (MH-1).

2-c. Preparation of 2nd Emulsion for High-Sensitivity Emulsion Layer

An emulsion was prepared in the same manner as in the preparation (2-b), except that an average grain size of the emulsion was changed to 0.8μ. This emulsion was designated (MH-2).

A blue-sensitive emulsion was prepared as follows.

3-a. Preparation of Emulsion for Blue-Sensitive Emulsion Layer

A silver iodobromide emulsion containing 3 mol% of silver iodide, having an average grain size of 0.8μ, and containing 100 g of silver halide and 70 g of gelatin per 1 kg of the emulsion, was prepared in a conventional manner. To a 1 kg portion of the emulsion were added 20 cc of a 5 wt% aqueous solution of 5-methyl-7-hydroxy-2,3,4-triazaindolizine and 600 g of yellow coupler containing emulsion (3), made according to the formula described below. Thereto, 50 cc of a 2 wt% aqueous solution of sodium 2-hydroxy-4,6-dichlorotriazine was further added as a gelatin hardening agent. Thus, the emulsion for forming a low-sensitivity unit emulsion layer was made, and this emulsion was designated as (B-1).

| Formula of Emulsion (3): | |
|---|---|
| (1) 10 wt % Gelatin Aqueous Solution | 1,000 g |
| (2) Sodium p-Dodecylbenzenesulfonate | 5 g |
| Tricresyl Phosphate | 80 cc |
| Yellow Coupler | 100 g |
| Ethyl Acetate | 120 cc |

Emulsification of the above-described ingredients was carried out in the same manner as the emulsion (1).

Structural Formula of Yellow Coupler:

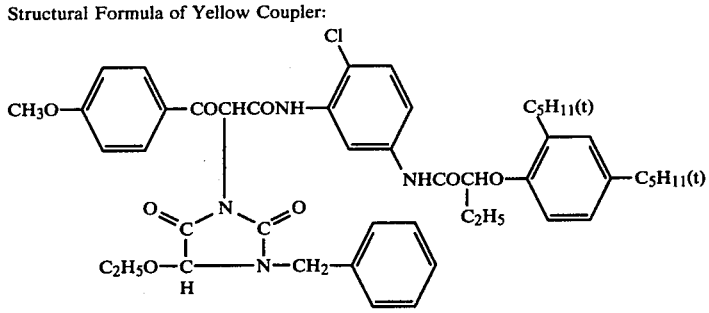

On a cellulose triacetate base, there was coated, in succession, the emulsion layers containing silver (in the respective amounts set forth in Table 1 shown hereinafter), interlayers, and a gelatin protective layer, in the same order as described in Table 1 (from a to h) to prepare a multilayer color reversal film.

The thus-obtained films (A), (B), (C), (D), and (E) were exposed to light for sensitometry, and processed in such a manner for color reversal processing as described below.

| Processing Step | Temperature | Time |
|---|---|---|
| First Development | 38° C. | 3 min |
| Washing | " | 1 min |
| Reversing | " | 2 min |
| Color Development | " | 6 min |
| Compensation | " | 2 min |
| Bleaching | " | 6 min |
| Fixing | " | 4 min |
| Washing | " | 4 min |
| Stabilization | " | 1 min |
| Drying | | |

Compositions of the processing solutions employed in the above-described processing steps, respectively, are described below.

| Composition of First Developing Solution | |
|---|---|
| Water | 800 ml |
| Sodium Tetrapolyphosphate | 2.0 g |
| Sodium Bisulfite | 8.0 g |
| Sodium Sulfite | 37.0 g |
| 1-Phenyl-3-pyrazolidone | 0.35 g |
| Hydroquinone | 5.5 g |
| Sodium Carbonate (monohydrate) | 28.0 g |
| Potassium Bromide | 1.5 g |
| Potassium Iodide | 13.0 g |
| Sodium Thiocyanate | 1.4 g |
| Water to make | 1.0 l |
| **Composition of Reversing Solution** | |
| Water | 800 ml |
| Hexasodium Nitrilo-N,N,N—trimethylenephosphonate | 3.0 g |
| Stannous Chloride (dihydrate) | 1.0 g |
| Sodium Hydroxide | 8.0 g |
| Glacial Acetic Acid | 15.0 ml |
| Water to make | 1.0 l |
| **Composition of Color Developing Solution** | |
| Water | 800 ml |
| Sodium Tetrapolyphosphate | 2.0 g |
| Benzyl Alcohol | 5.0 ml |
| Sodium Sulfite | 7.5 g |
| Sodium Tertiary Phosphate (dodecahydrate) | 36.0 g |
| Potassium Bromide | 1.0 g |
| Potassium Iodide | 90.0 mg |
| Sodium Hydroxide | 3.0 g |
| Citrazinic Acid | 1.5 g |
| 4-Amino-3-methyl-N—ethyl-β-hydroxy- | 11.0 g |

-continued

| | |
|---|---|
| ethylanilinesesquisulfatemonohydrate | |
| Ethylenediamine | 3.0 g |
| Water to make | 1.0 l |
| **Composition of Compensating Solution** | |
| Water | 800 ml |
| Glacial Acetic Acid | 5.0 ml |
| Sodium Hydroxide | 3.0 g |
| Dimethylaminoethaneisothiourea (dichlorate) | 1.0 g |
| Water to make | 1.0 l |
| **Composition of Bleaching Solution** | |
| Water | 800 ml |
| Sodium Ethylenediaminetetraacetate (dihydrate) | 2.0 g |
| Ammonium Ethylenediaminetetraacetato-ferrate (III) (dihydrate) | 120.0 g |
| Potassium Bromide | 100.0 g |
| Water to make | 1.0 l |
| **Composition of Fixing Solution** | |
| Water | 800 ml |
| Ammonium Thiosulfate | 80.0 g |
| Sodium Sulfite | 5.0 g |
| Sodium Bisulfite | 5.0 g |
| Water to make | 1.0 l |
| **Composition of Stabilizing Bath** | |
| Water | 800 ml |
| Formalin (37 wt %) | 5.0 ml |
| Fuji Driwel | 5.0 ml |
| Water to make | 1.0 l |

The density measurements of each of the thus-processed color reversal films were carried out using a blue light filter, a green light filter and a red light filter, respectively.

On the other hand, in order to evaluate the image sharpness, each of the color reversal film samples was exposed to white light through a black-and-white high contrast image and a filter having a repeated pattern of linear stripes having the same density difference as in the contrast image (frequency: 30 cycle/mm) and then processed in the same manner as described above. The density measurements of each of the thus-processed samples were carried out on a microdensitometer through a green filter and a red filter, respectively, and thereby squarewave response functions defined by the following equation (which is abbreviated as S.R.F. hereinafter) were determined.

$$S.R.F. = (D_{max} - D_{min})/\Delta D$$

wherein $D_{max}$ is the maximum value of microdensity of the striped pattern image, $D_{min}$ is the minimum value of micro density of striped pattern image, and $\Delta D$ is a difference between the maximum density of sharp contrast image and the minimum density of sharp contrast image. According to this equation, the greater the S.R.F. value, the better the sharpness will be.

Further, color reproducibility was evaluated by measuring the differences in sensitivity between the green-sensitive layer (G) and the red-sensitive layer (R) upon exposure through a green filter (BPN 42), and between the blue-sensitive layer (B) and the green-sensitive layer (G) upon exposure through a blue filter (BPN 53). Therein, the sensitivity is defined as the logarithm of exposure necessary to give D=1.5, and the greater difference the differently sensitized layers develop in sensitivity, the better color isolation and the higher color reproducibility the sensitive material exhibits. The expressions $\Delta\log E_{G1.5}$ (G−R) and $\Delta\log E_{B1.5}$ (B−G) given in Table 2 refer to the difference in sensitivity between the layer G and the layer R upon exposure to green light and to the difference in sensitivity between the layer B and the layer G upon exposure to blue light, respectively.

Further, the graininess of image obtained was evaluated by measuring R.M.S. granularity under exposure to visible light through an aperture having a diameter of 48 mm. Therein, the R.M.S. granularity is defined as (R.M.S. value in the area of D=1.0)×1,000, and the smaller a value of the R.M.S. granularity, the better the graininess.

The results obtained are shown in Table 2.

TABLE 1

| | Film A (Comparison) | Film B (Comparison) | Film C (Comparison) | Film D (This Invention) | Film E (This Invention) |
|---|---|---|---|---|---|
| | Support | Support | Support | Support | Support |
| a | CL-1 (0.5) | CH-2 (0.5) | CL-1 (0.5) | CH-2 (0.5) | CL-1 (0.5) |
| b | CH-1 (0.5) | MH-2 (0.5) | CH-1 (0.5) | CL-2 (0.5) | CH-1 (0.5) |
| c | Gelatin Interlayer | Gelatin Interlayer | Gelatin Interlayer | Gelatin Interlayer | Gelatin Interlayer |
| d | ML-1 (0.5) | CL-2 (0.5) | MH-2 (0.5) | MH-2 (0.5) | MH-2 (0.5) |
| e | MH-1 (0.5) | ML-2 (0.5) | Yellow Filter Layer | ML-2 (0.5) | ML-2 (0.5) |
| f | Yellow Filter Layer | Yellow Filter Layer | B-1 (1.0) | Yellow Filter Layer | Yellow Filter Layer |
| g | B-1 (1.0) | B-1 (1.0) | ML-3 (0.5) | B-1 (1.0) | B-1 (1.0) |
| h | Gelatin Protective Layer | Gelatin Protective Layer | Gelatin Protective Layer | Gelatin Protective Layer | Gelatin Protective Layer |

Therein, values in parentheses represent coverage of their respective emulsion layers, converted to a basis of coated silver amount (g/m²).

TABLE 2

| | Film A (Comparison) | Film B (Comparison) | Film C (Comparison) | Film D (This Invention) | Film E (This Invention) |
|---|---|---|---|---|---|
| Magenta Image | | | | | |
| Sensitivity | 100 | 100 | 100 | 100 | 100 |
| Gamma | 1.70 | 1.65 | 1.70 | 1.70 | 1.70 |
| S.R.F. | 0.47 | 0.42 | 0.60 | 0.55 | 0.55 |
| Cyan Image | | | | | |
| Sensitivity | 100 | 97 | 100 | 100 | 100 |
| Gamma | 1.70 | 1.60 | 1.70 | 1.70 | 1.70 |
| S.R.F. | 0.20 | 0.40 | 0.35 | 0.30 | 0.31 |
| $\Delta$ Log$E_{G1.5}$(G-R) | 1.0 | 0.8 | 1.0 | 1.0 | 1.0 |
| $\Delta$ Log$E_{B1.5}$(B-G) | 1.5 | 1.5 | 0.85 | 1.5 | 1.5 |
| R.M.S. | 10.5 | 9.5 | 9 | 9.5 | 9.5 |

As can be seen from Table 1 and Table 2, remarkable improvements in the sharpness and the graininess properties of images obtained were achieved in both the sensitive materials (D) and (E) which were produced in accordance with embodiments of this invention, compared with the sensitive material (A) employed conventionally.

Further, compared with in the sensitive material (B) as described in Japanese Patent Application (OPI) No. 25738/81, the color isolation of the magenta layer and the cyan layer from each other was improved to a greater extent in both of the sensitive materials of this invention and consequently, the color reproducibility of the sensitive materials of this invention were heightened. Although the color reproducibility of the sensitive material (B) can be improved by providing interlayers between a and b, and further between d and e, a thickness of the material as a whole increases and, therefrom, a decrease in image sharpness results. The image sharpness in the magenta layer has proved to be improved as compared with the conventional sensitive materials fallen outside this invention.

Furthermore, compared with the sensitive material (C) as described in U.S. Pat. No. 4,157,917, the sensitive materials of this invention were found to be improved in the color isolation of the magenta layer and the yellow layer from each other, and consequently, in the color reproducibility.

While the invention has been described in detail and with reference to specific embodiments thereof, it will be apparent to one skilled in the art that various changes and modifications can be made therein without departing from the spirit and scope thereof.

What is claimed is:

1. A multilayer color reversal light-sensitive material comprising a support, a yellow filter layer, a group of green-sensitive emulsion layers, and a group of red-sensitive emulsion layers, wherein said emulsion layer groups are positioned nearer to the support than the yellow filter layer, each of the emulsion layer groups comprises at least two adjacent layers, including a high-sensitivity silver halide emulsion layer containing a coupler and silver halide grains having an average size of from 0.6μ to 2.0μ, and a low-sensitivity silver halide emulsion layer containing a coupler and silver halide grains having an average size of from 0.1μ to 0.5μ, and at least one of the green-sensitive low-sensitivity emulsion layer or the red-sensitive low-sensitivity emulsion layer is positioned farther from the support than the high-sensitivity emulsion layer of the corresponding emulsion layer group.

2. A multilayer color reversal light-sensitive material as in claim 1, wherein both the green-sensitive, low-sensitivity emulsion layer and the red-sensitive, low-sensitivity emulsion layer are positioned farther from the support than the high-sensitivity emulsion layer of the corresponding emulsion layer group.

3. A multilayer color reversal light-sensitive material as in claim 1 or 2, wherein the red-sensitive emulsion layer group is positioned closer to the support than the green-sensitive emulsion layer group.

4. A multilayer color reversal light-sensitive material as in claim 1 or 2, wherein a blue-sensitive emulsion layer is provided at a position farther from the support than the yellow filter layer.

5. A multilayer color reversal light-sensitive material as in claim 3, wherein a blue-sensitive emulsion layer is provided at a position farther from the support than the yellow filter layer.

6. A multilayer color reversal light-sensitive material as in claim 1 or 2, wherein the high-sensitivity silver halide emulsion layers contain silver halide grains having an average grain size of from 0.7μ to 1.5μ, and the low-sensitivity silver halide emulsion layers contain silver halide grains having an average size of from 0.15μ to 0.4μ.

7. A multilayer color reversal light-sensitive material as in claim 3, wherein the high-sensitivity silver halide emulsion layers contain silver halide grains having an average grain size of from 0.7μ to 1.5μ, and the low-sensitivity silver halide emulsion layers contain silver halide grains having an average size of from 0.15μ to 0.4μ.

8. A multilayer color reversal light-sensitive material as in claim 4, wherein the high-sensitivity silver halide emulsion layers contain silver halide grains having an average grain size of from 0.7μ to 1.5μ, and the low-sensitivity silver halide emulsion layers contain silver halide grains having an average size of from 0.15μ to 0.4μ.

9. A multilayer color reversal light-sensitive material as in claim 5, wherein the high-sensitivity silver halide emulsion layers contain silver halide grains having an average grain size of from 0.7μ to 1.5μ, and the low-sensitivity silver halide emulsion layers contain silver halide grains having an average size of from 0.15μ to 0.4μ.

* * * * *